US006460617B1

(12) United States Patent
Allen

(10) Patent No.: US 6,460,617 B1
(45) Date of Patent: Oct. 8, 2002

(54) DRILLABLE CASING BRUSH

(75) Inventor: Anthony Allen, Aberdeen (GB)

(73) Assignee: Ruff Pup Limited, North Lincolnshire (GB)

( * ) Notice: Subject to any disclaimer, the term of this patent is extended or adjusted under 35 U.S.C. 154(b) by 0 days.

(21) Appl. No.: 09/591,819

(22) Filed: Jun. 12, 2000

(30) Foreign Application Priority Data

Aug. 31, 1999 (GB) ..... 9920538
Mar. 31, 2000 (GB) ..... 0007708

(51) Int. Cl.[7] ..... E21B 37/02

(52) U.S. Cl. ..... 166/173; 166/176; 166/177.4; 15/104.2

(58) Field of Search ..... 166/170, 173, 166/176, 177.4, 311; 15/104.05, 104.16, 104.2

(56) References Cited

U.S. PATENT DOCUMENTS 3,827,492 A * 8/1974 Hammon et al. ..... 166/173
4,501,322 A * 2/1985 Martin ..... 166/173
4,703,804 A * 11/1987 Stokes et al. ..... 166/311
4,896,720 A 1/1990 DeRouen ..... 166/170
5,570,742 A * 11/1996 Reynolds et al. ..... 166/173
5,884,700 A * 3/1999 Cook et al. ..... 166/153
6,209,647 B1 * 4/2001 Brown ..... 166/311

FOREIGN PATENT DOCUMENTS

GB 2 295 632 6/1996
GB 2 299 599 10/1996

* cited by examiner

*Primary Examiner*—William Neuder
*Assistant Examiner*—Jennifer R. Dougherty
(74) *Attorney, Agent, or Firm*—Fay, Sharpe, Fagan, Minnich & McKee, LLP

(57) ABSTRACT

A casing brush for cleaning the walls of a well casing, the casing brush comprising a body (1) in which are mounted cleaning bristles (2) and an adapter (4) to connect the upper end of the body (1) to the lower end of a bridge plug. The body (1) and the adapter (4) are comprised of a material which is at least drillable by a rock bit.

12 Claims, 2 Drawing Sheets

DRILLABLE CASING BRUSH

The present invention relates to a drillable casing brush for use in oil and gas wells.

When carrying out work on a well casing it is usual to set a drillable bridge plug or packer in place within the well casing. The bridge plug is lowered into the well on the drill pipe string to the desired depth and mechanically set in place. This may be achieved by rotating the string, to cause the centre of the plug to rotate relative to the outer casing (which is prevented from rotating freely as a result of friction with the inner wall of the well casing) and expend, though other systems are known for setting the plug. Once set the bridge plug seals the well and isolates the depths below it.

The bridge plug may be further secured in place within the well casing by pumping cement into the well to set solid around the bridge plug, both above and below it.

It is necessary to form a fluid tight seal between the well casing and the bridge plug and to this end it is usual to carry out a separate "cleaning run" prior to inserting the bridge plug. This entails running a well casing scraper through the well casing to remove dirt and debris adhering to the walls thereof. The cleaning run can add several hours to the well plugging operation and this represents lost rig operating time which can cost thousands of pounds.

It is an object of the present invention to provide a casing brush which can be used in conjunction with a bridge plug, thereby avoiding the need for a separate cleaning run to be carried out on the well casing.

It is a further object of the present invention to provide a method of plugging a well casing in which the cleaning run and plugging operations are combined.

According to a first aspect of the present invention there is provided a casing brush for cleaning the walls of a well casing, the casing brush comprising a body in which are mounted cleaning bristles and an adapter to connect the upper end of the body to the lower end of a bridge plug, wherein the body and the adapter are comprised of a material which is at least drillable by a rock bit.

In use the casing brush is connected beneath the bridge plug using the adapter. Then, both the casing brush and the bridge plug are inserted into the well casing. The casing brush running below the bridge plug cleans the walls of the well casing and thus ensures a clean surface against which to set the bridge plug in place. This is important if an effective seal is to be provided. Since both the well cleaning and well plugging operations are carried out together the downtime of the well is significantly reduced.

Once the well has been serviced the bridge plug, the adapter and the casing brush can be drilled out together using a rock bit, a PDC bit or the like. Generally speaking, a rock bit is the least suitable type of bit employed in drilling well bores which can be used for drilling out the casing brush. Therefore, if the material from which the casing brush is comprised is capable of being drilled by a rock bit it will also be capable of being drilled by any other bit which might be used.

In a preferred embodiment of the present invention the drillable bridge plug is connected to the drillable casing brush via a swivel to facilitate unimpeded rotation of the bridge plug relative to the casing brush. In this regard, it will be understood that rotation of the drill pipe string is necessary to set the plug in place.

Preferably, the swivel may be adapted to provide a fixed (i.e. non-rotational linkage) between the bridge plug and casing brush if the bridge plug is of a type which does not need to be rotated to mechanically set it in place. To this end, the swivel can be locked to prevent rotation of the casing brush relative to the bridge plug. Conveniently, this is achieved by aligning one or more holes in the body of the casing brush with holes in the swivel, and inserting a locking pin through each pair of aligned holes.

Preferably, the casing brush body is comprised of aluminium, but any material which is capable of being drilled by a rock bit will serve the purpose. Alloys or cast iron may also be used.

Preferably, the casing brush body is tubular with the lower end thereof closed and has holes in the side thereof through which cleaning fluid can be pumped to assist the cleaning action of the bristles.

Preferably, slots are provided in and around the adapter at the upper end of the brush body and in and around the lower end of the brush body through which cement can pass to hold the brush fast. This is helpful when the brush comes to be drilled out.

According to a second aspect of the present invention there is provided a bridge plug and a casing brush in combination, the casing brush being connected to the lower end of the bridge plug by means of an adapter, and the bridge plug, the casing brush and the adapter being comprised of a material which is at least drillable by a rock bit.

According to a third aspect of the present invention there is provided a method of cleaning and plugging a well casing in which:

a) a combined bridge plug and casing brush with the casing brush situated below the bridge plug are run down a well casing;
b) the walls of the well casing are cleaned by the casing brush;
c) the bridge plug is set in place; and
d) after the well has been serviced both the bridge plug and the casing brush are drilled out.

Cement may be pumped through holes in the side of the casing brush to set same in place within the well casing. This serves to hold the casing brush fast which assists when it is drilled out.

An embodiment of the present invention will now be described, by way of example, with reference to the accompanying drawings, in which.

Figure 1:
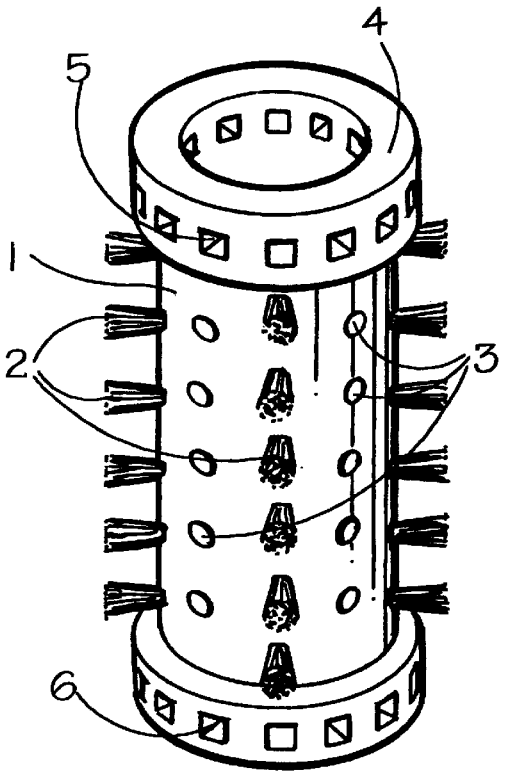
FIG. 1 shows a well casing brush according to the present invention.

Referring to FIG. 1 the well casing brush comprises a tubular central body 1 having a plurality of cleaning bristles 2 embedded in the outer wall thereof. The cleaning bristles 2 are conveniently comprised of non-ferrous material, but the present invention is not restricted in this way. The central body is comprised of a drillable material such as, for example, aluminium, cast iron or any soft alloy. In the context of the present invention a drillable material is any material which can be drilled by a well bore drilling bit and, in particular, a rock bit. Since a rock bit is the least suited of such bits for drilling out a well casing it follows that if the material can be drilled by a rock bit it can also be drilled out by any other type of bit including a PDC bit. Holes 3 are also provided in the outer wall of the central body 1 through which cleaning fluid can be pumped to assist the cleaning action of the bristles 2. To facilitate this the lower end of the tubular central body 1 is closed.

Figure 2:
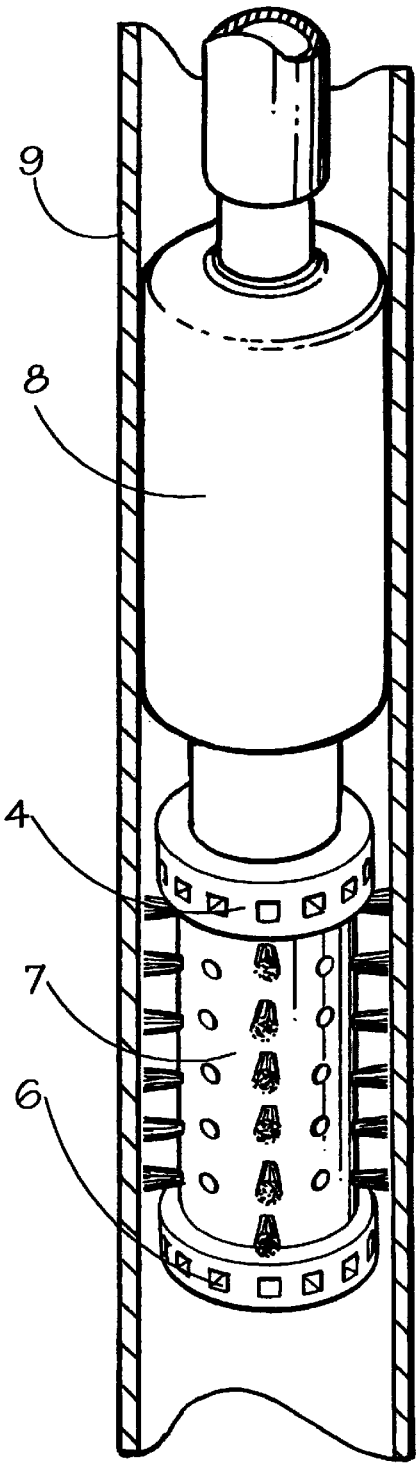
FIG. 2 shows the well casing brush of FIG. 1 in combination with a bridge plug, the combined apparatus being in use within a well casing.

At the upper end of the central body there is provided an adapter 4 which facilitates connection to the lower end of a drillable bridge plug as shown in FIG. 2. The adapter 4 is chosen to suit the particular drillable bridge plug with which it will be used.

Slots 5 are provided in the adapter 4 to allow cement which is pumped into the combined casing brush and bridge plug after the cleaning operation has been completed to seal the bridge plug to also fix the casing brush in place. By fixing the casing brush in this way it is easier to drill it out. Holes 6 are also provided in the lower end of the tubular body 1 for this same purpose.

Referring to FIG. 2 there is shown the casing brush 7 described hereinabove with reference to FIG. 1 connected to the lower end of a drillable bridge plug 8. The combined units are inserted together into a well bore casing 9. In use the well bore casing 9 is cleaned by the casing brush 7 and then cement is pumped down to the bridge plug 8 to seal it in place. Once work on the well bore casing is completed the casing brush 7 and the bridge plug 8 are drilled out. Normally a separate cleaning operation would be carried out prior to inserting the drillable plug, but the casing brush of the present invention avoids the need for this, thus saving an additional round trip for the drilling rig and further down time thereof.

The lower end of the casing brush 7 can be either open or closed. The same applies to the bridge plug 8 to which the casing brush 7 is connected.

The combination of open/closed in the bridge plug and casing brush are many depending on the specific operating requirements within a given well.

Figure 3:
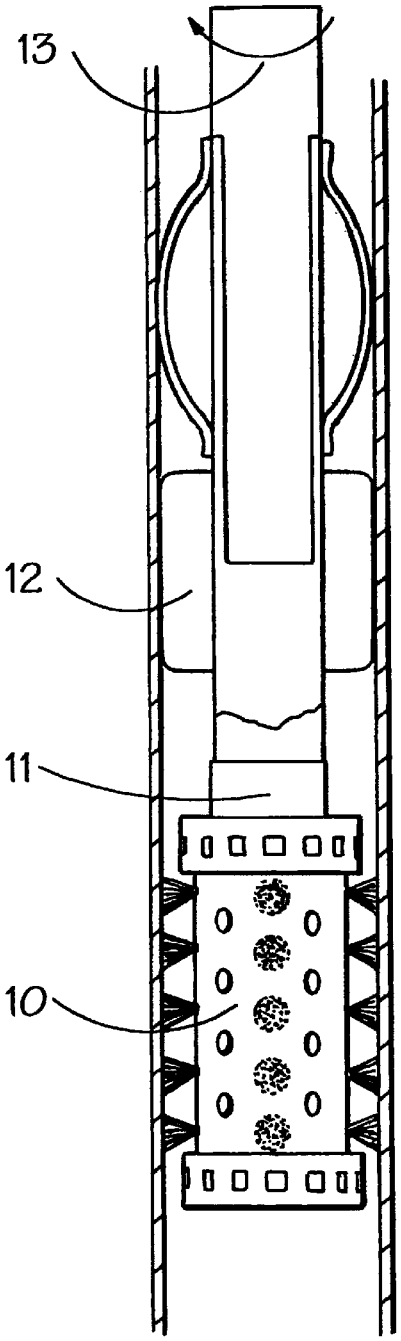
FIG. 3 shows a well casing brush according to a further embodiment of the present invention, in combination with a drillable bridge plug.
Figure 4:
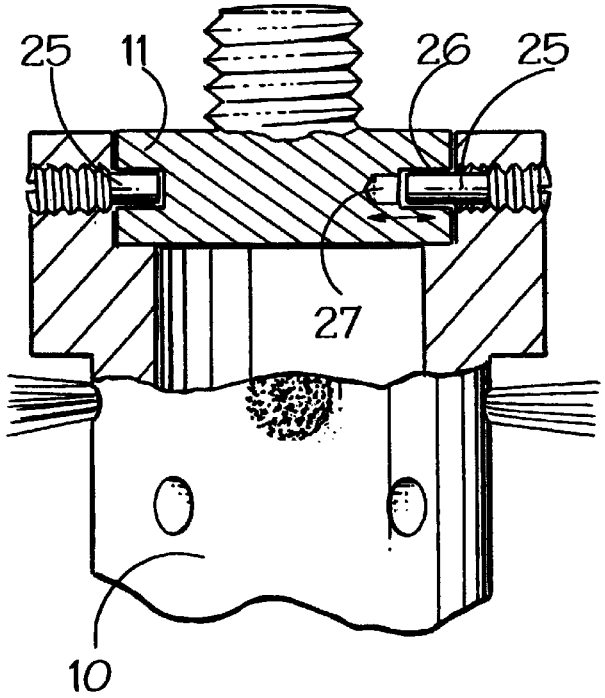
FIG. 4 shows an enlarged sectional view of the swivel adapter of the well casing brush according to the present invention shown in FIG. 3.

Referring to FIG. 3 of the drawing here is shown a drillable casing brush 10 which is in all essential respects, but one, identical to the casing brush shown in FIGS. 1 and 2. The casing brush of FIG. 3 also comprises an adapter 11 at its uppermost end to connect the casing brush 10 to the lowermost end of a drillable bridge plug 12, but in this embodiment the adapter 11 takes the form of a torque free swivel. FIG. 4 of the drawings shows an enlarged sectional view of the adapter 11. It will be seen that the adapter 11 is received within an enlarged section of the through bore in the casing brush 10 and is held in place by means of pins 25, each of which passes through a hole in the casing 10 into a circumferential channel 26 in the adapter 11. As shown the adapter 11 is able to rotate relative to the casing 10. However, by inserting a longer pin into a hole 27 in the bottom of the channel 26 the adapter 11 and casing 10 are locked together. To "set" the drillable bridge plug 12 it is run in a well attached to a setting tool 13 which is attached to the drill string (not visible). When the desired setting depth is reached the drill string is rotated a number of turns to the right. This forces the bridge plug 12 to shorten and thus expand to block the well. In order to achieve this setting, the lower part of the bridge plug has to turn freely otherwise the tool cannot shorten and expand. The casing brush 10 attached to the bottom, centre, of the bridge plug 12 has a tendency to hold the centre of the bridge plug 12 from turning due to the friction of the brush bristles against the casing wall. The torque free swivel adapter 11 solves this problem by allowing the totally torque free attachment of the casing brush to the lower part of the bridge plug.

The setting tool 13 has spring loaded blocks 14 which grip the inside of the well casing to hold the outside of the bridge plug 12 from any rotation during the turning of the centre. Of course, it will be understood that where the bridge plug is of a type that is not set by rotation of the drill string the swivel adapter may be locked up to prevent unnecessary rotation.

What is claimed is:

1. A casing brush for cleaning the walls of a well casing, the casing brush comprising a body in which are mounted cleaning bristles and an adapter to connect the upper end of the body to the lower end of a bridge plug, wherein the body and the adapter are comprised of a material which is at least drillable by a rock bit, and wherein slots are provided in and around the adapter at the upper end of the brush body and in and around the lower end of the brush body through which cement can pass to hold the brush fast.

2. The drillable casing brush according to claim 1, wherein the adapter comprises a swivel to facilitate unimpeded rotation of the bridge plug relative to the casing brush.

3. The drillable casing brush according to claim 2, wherein the swivel can be adapted to provide a fixed (i.e. non-rotational linkage) between the bridge plug and casing brush.

4. The drillable casing brush according to claim 3, wherein the casing brush body is comprised of aluminium.

5. The drillable casing brush according to claim 3, wherein the casing brush body is tubular and has holes in the sides thereof through which cleaning fluid can be pumped to assist the cleaning action of the bristles.

6. The drillable casing brush according to claim 2, wherein the casing brush body is comprised of aluminium.

7. The drillable casing brush according to claim 2, wherein the casing brush body is tubular and has holes in the sides thereof through which cleaning fluid can be, pumped to assist the cleaning action of the bristles.

8. The drillable casing brush according to claim 1, wherein the casing brush body is comprised of aluminium.

9. The drillable casing brush according to claim 8, wherein the casing brush body is tubular and has holes in the sides thereof through which cleaning fluid can be pumped to assist the cleaning action of the bristles.

10. The drillable casing brush according to claim 1, wherein the casing brush body is tubular and has holes in the side thereof through which cleaning fluid can be pumped to assist the cleaning action of the bristles.

11. A drillable casing brush for cleaning the walls of a well casing, the casing brush comprising a body in which are mounted cleaning bristles and an adapter to connect the upper end of the body to the lower end of a bridge plug, said adapter comprising a swivel to facilitate unimpeded rotation of the bridge plug relative to the casing brush, wherein the body and the adapter are comprised of a material which is at least drillable by a rock bit, and wherein slots are provided in and around the adapter at the upper end of the brush body and in and around the lower end of the brush body through which cement can pass to hold the brush fast.

12. A drillable casing brush for cleaning the walls of a well casing, the casing brush comprising a body in which are mounted cleaning bristles and an adapter to connect the upper end of the body to the lower end of a bridge plug, wherein the body and the adapter are comprised of a material which is at least drillable by a rock bit, wherein the casing brush body is tubular and has holes in the side thereof through which cleaning fluid can be pumped to assist the cleaning action of the bristles, and wherein slots are provided in and around the adapter at the upper end of the brush body and in and around the lower end of the brush body through which cement can pass to hold the brush fast.

* * * * *